United States Patent [19]

Smith

[11] 4,239,468

[45] Dec. 16, 1980

[54] APPARATUS FOR CONTROLLING PRESSURE DISTRIBUTION IN GEAR PUMP

[75] Inventor: Brian W. Smith, Wooster, Ohio

[73] Assignee: The Rexroth Corporation, Bethlehem, Pa.

[21] Appl. No.: 940,808

[22] Filed: Sep. 8, 1978

[51] Int. Cl.[3] ..... F04C 2/18

[52] U.S. Cl. ..... 418/78; 418/132

[58] Field of Search ..... 418/76, 78, 132, 131

[56] References Cited

U.S. PATENT DOCUMENTS

| | | | |
|---|---|---|---|
| 1,706,829 | 3/1929 | Thomson | 418/76 |
| 2,541,010 | 2/1951 | Ungar | 418/78 X |
| 2,923,248 | 2/1960 | Hodgson | 418/132 |
| 2,981,200 | 4/1961 | Stephen | 418/131 |
| 3,213,799 | 10/1965 | Trick | 418/132 X |
| 3,251,309 | 5/1966 | Schmiel et al. | 418/132 X |
| 3,416,459 | 12/1968 | Reimer et al. | 418/132 |
| 3,474,736 | 10/1969 | Lauck | 418/135 X |
| 3,499,390 | 3/1970 | Prijatel | 418/132 |
| 3,833,319 | 9/1974 | Eglington | 418/132 |
| 4,087,216 | 5/1978 | Shumate | 418/74 |

*Primary Examiner*—Leonard E. Smith

*Attorney, Agent, or Firm*—Michael J. Striker

[57] ABSTRACT

A pressure plate provides metering grooves in a face thereof contiguous to the gears of a gear pump. The grooves communicate certain pockets between adjacent gear teeth with other such pockets so as to meter fluid from pockets in which fluid is trapped at relatively high pressures to pockets in which fluid is trapped at relatively low pressures, thereby controlling the pressure distribution.

16 Claims, 10 Drawing Figures

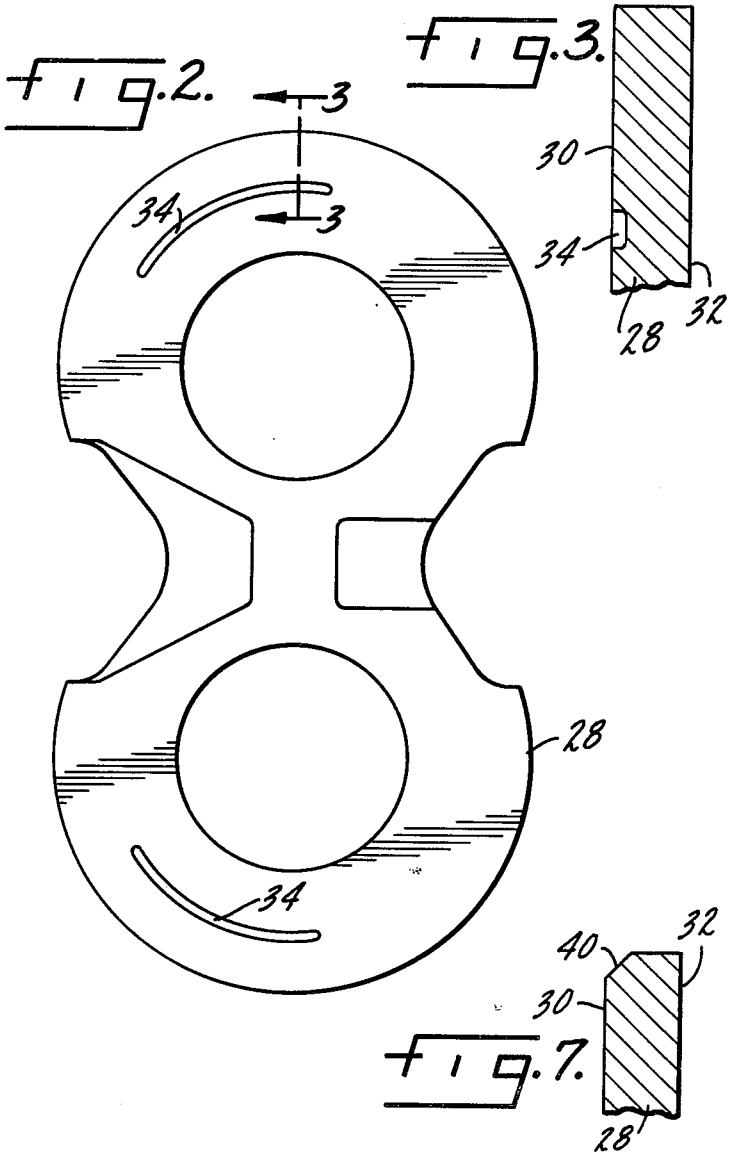
FIG. 2.
FIG. 3.
FIG. 7.
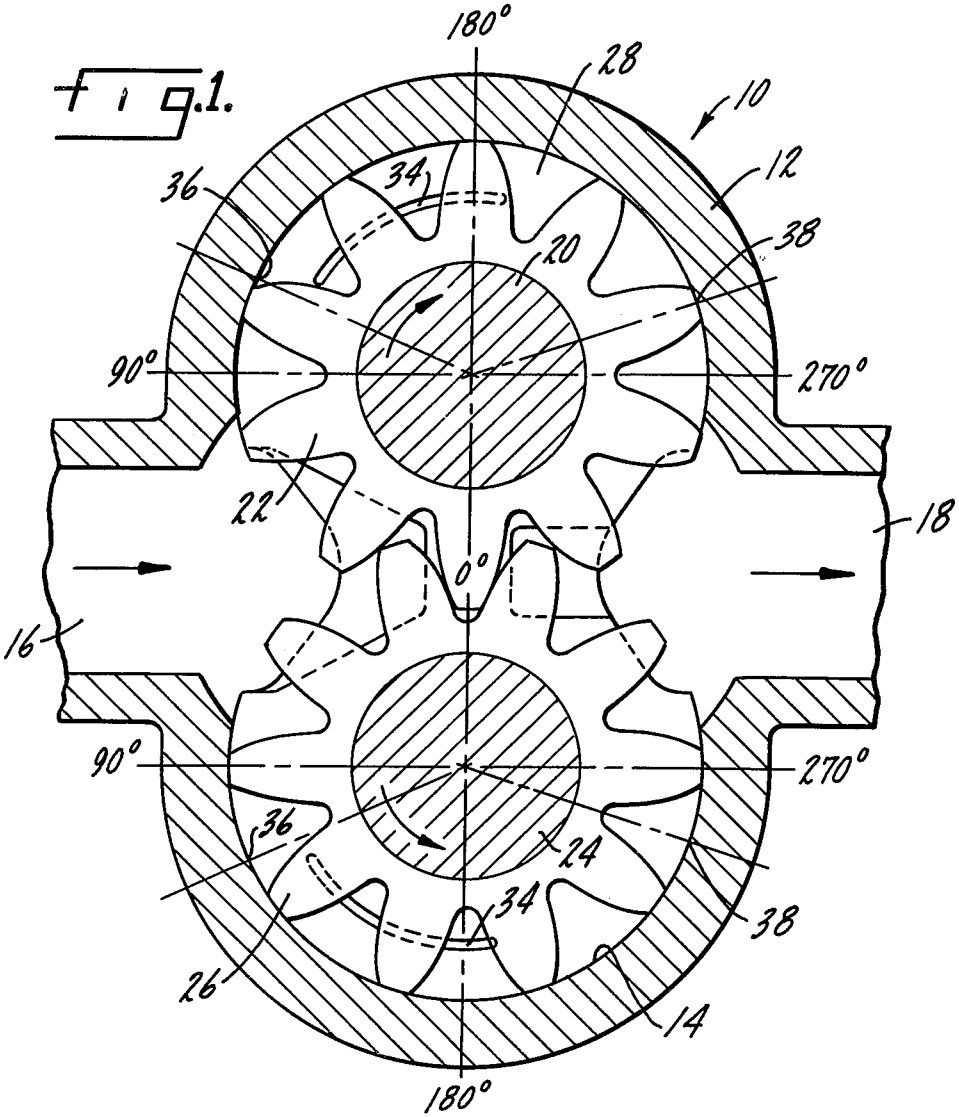
FIG. 1.

12
14
20
22
24
26
34
36
38
42
44
46

APPARATUS FOR CONTROLLING PRESSURE DISTRIBUTION IN GEAR PUMP

BACKGROUND OF THE INVENTION

This invention relates generally to fluid pumps. More particularly it relates to a gear pump having provisions for maintaining pressure distribution at acceptable levels when the pump is operated in an environment wherein conditions beyond original design specifications are encountered.

During operation of a gear pump, the gear teeth rotate in a gear pocket bore. As the teeth move into contact with the pump housing at the inlet seal point, pockets are formed in which fluid is trapped. With continued rotation of the gears, fluid pressure rises as these pockets move toward the pump outlet. When the gear teeth reach what may be termed the discharge seal point, the pockets are communicated with the pump outlet. Thus there are three zones, a first, inlet zone at inlet pressure, a second, intermediate zone between the inlet and outlet seal points in which there is a pressure rise from inlet pressure to discharge pressure, and a third, outlet zone at discharge pressure. The internal pressure distribution profile between the seal points is a matter of pump design.

When a gear pump is operated under load, volumetric efficiency is maintained by loading at least one pressure plate in contact with the side faces of the gears to close pump clearance gaps. During the pumping operation, fluid pressure increases as it is moved from the inlet to the outlet while trapped in the pockets. Since a fluid under pressure creates a force acting equally in all directions, a force exists which acts in a direction parallel to the axes of the gears. This force tends to bias the pressure plate away from the gears. To counteract this, a fixed area on the back of housing side of the plate is sealed to contain a compartment of oil at discharge pressure. Since this area is fixed, the force created here is constant for any given discharge pressure. Optimum pump design does not balance the force on the front or gear side of the plate, but rather overbalances slightly so as to bias the plate toward the gears in such a manner that a high degree of volumetric efficiency is maintained. However, the magnitude of the force on the front side of the plate is dependent upon a number of variables including discharge pressure, pump speed, fluid viscosity and inlet pressure, while the magnitude of the force on the back side of the plate is dependent only upon discharge pressure. Thus, the degree of overbalance varies considerably from one set of operating conditions to another.

Heretofore a typical pump design might anticipate that the inlet is subjected to atmospheric pressure or a slight sub-atmospheric pressure such as, for example, a vaccum of five inches of mercury. When such a pump is subjected to a vacuum of, for example, fifteen inches of mercury at the inlet, the pressure distribution profile is distorted such that the net force biasing the pressure plate toward the gears is increased. This results in a reduction of pump efficiency. Although the force on the back side of the plate could be reduced, such reduction would require additional tooling and modified seals.

There remains a need in the art for a gear pump which provides a simple, efficient and economical way to compensate for the overbalance which is encountered when the pump is operated beyond design applications with a corresponding decrease in pump efficiency. One particular application would be, for example, where the pump inlet is subjected to a higher vacuum than would have been considered practical heretofore.

SUMMARY OF THE INVENTION

This invention is directed to a gear pump which will meet the need noted above. Since the overbalance designed into a pump is in reality the difference between the opposing forces on each side of the pressure plate, an alternative to reducing the larger force would be to increase the smaller one. One way this may be accomplished simply and economically is by providing a slip passage in the form of a metering groove in the front or gear face of the plate so that fluid from a region of higher pressure is directed to a region of lower pressure, thereby reducing the overbalance and thus modifying the pressure distribution profile to an acceptable level.

A primary object of this invention is to provide an improved gear pump having at least one pressure plate defining metering grooves in the face thereof contiguous to the gears. These grooves are oriented so as to communicate certain pockets between the seal points in such a manner as to meter fluid from relatively high pressure pockets to relatively low pressure pockets and thereby control the pressure distribution profile. The result is that the use of a pump may be extended to an environment wherein pump inlet pressure is beyond that for which the pump was originally designed.

BRIEF DESCRIPTION OF THE DRAWINGS

The objects and advantages of this invention will become apparent to those skilled in the art upon careful consideration of the specification herein, including the drawings, wherein:

FIG. 1 is a sectional view of an improved gear pump including a pressure plate provided with suitable metering grooves;

FIG. 2 is a front view of the pressure plate shown in FIG. 1;

FIG. 3 is a partial end view taken along the line 3—3 of FIG. 3 and enlarged for clarity;

FIG. 7 is a partial end view, similar to FIG. 3, showing a modified form of the pressure plate;

Figures 4, 5, 8, 9, 10:
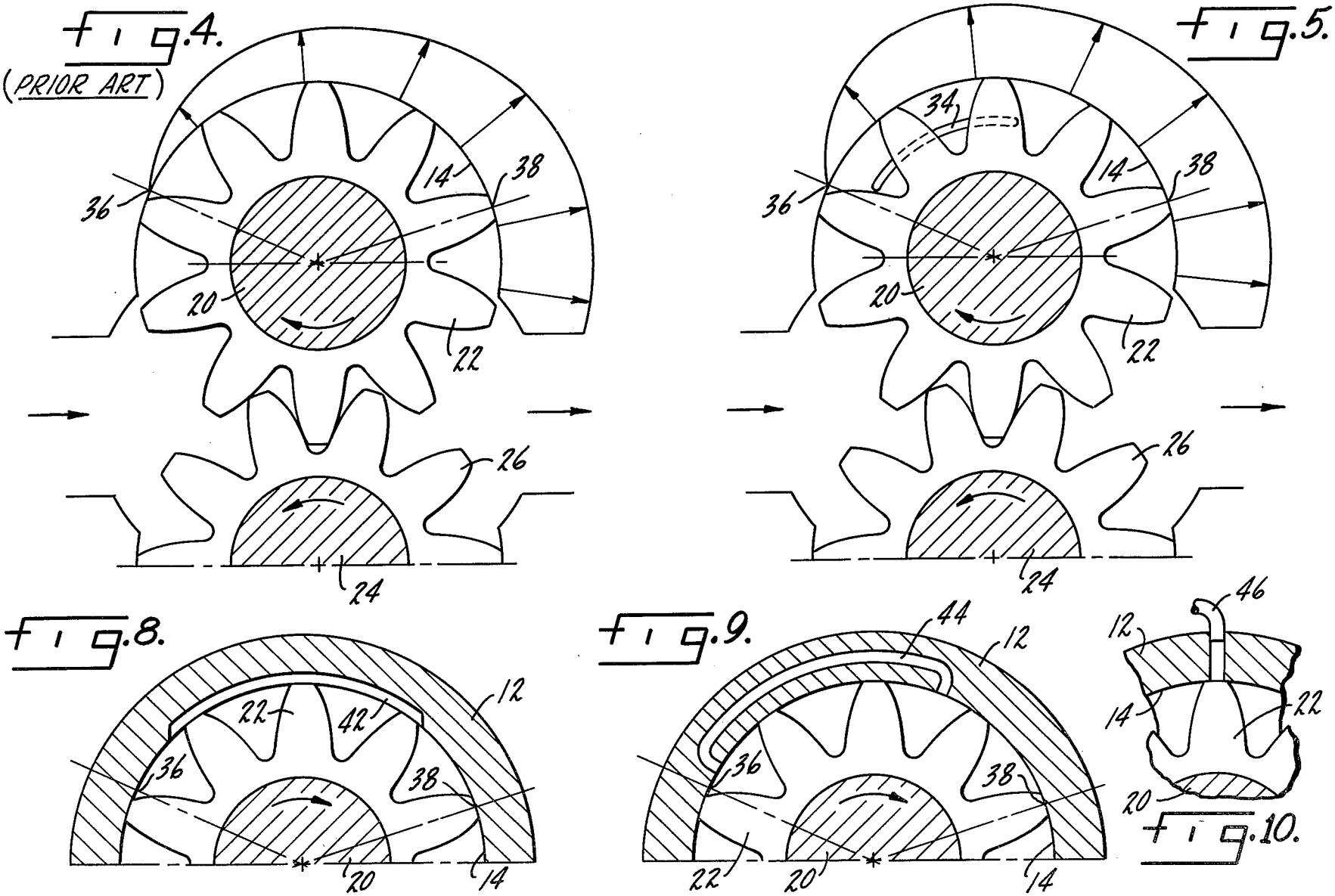
FIG. 4. (PRIOR ART)
FIG. 4 is a partial diagrammatic view, similar to FIG. 1, on which is superimposed the pressure distribution profile for a conventional prior art gear pump.
FIG. 5 is a partial diagrammatic view, similar to FIG. 4, on which is superimposed the pressure distribution profile for an improved gear pump incorporating the pressure plate of FIG. 2.
FIG. 8 is a partial sectional view, similar to FIG. 1, showing a modified form of the improved gear pump.
FIG. 9 is a partial sectional view, similar to FIG. 1, showing still another modified form of the improved gear pump.
FIG. 10 is a partial sectional view, similar, to FIG. 1, showing yet another modified form of the improved gear pump.

While this invention is susceptible of embodiment in many different forms, there is shown in the drawings and herein will be described in detail one preferred and other modified embodiments of the invention. It should be understood that the present disclosure is to be considered as an exemplification of the principles of the invention and is not intended to limit the invention to these embodiments.

DESCRIPTION OF THE PREFERRED EMBODIMENT

Referring now to the drawings in greater detail, there is shown an improved gear pump 10 having a suitable housing 12 defining an interior chamber 14 formed by suitable gear pocket bores. An inlet 16 and an outlet 18 are in fluid communication with chamber 14 of housing 12.

A first, drive shaft 20 is supported for rotation within housing 12. A first, drive gear 22 is secured to shaft 20 for rotation in chamber 14. Similarly, a second, driven shaft 24 is supported for rotation within housing 12. A second, driven gear 26 is secured to shaft 24 for rotation in chamber 14. Gears 22 and 26 are in meshing engagement.

A pressure or wear plate 28 conforms generally to the configuration of chamber 14. Pressure plate 28 has a front or gear face 30 contiguous to the side faces of gears 22 and 26. Pressure plate 28 also has a back or housing face 32 contiguous to housing 12. As most clearly shown in FIGS. 2 and 3, a pair of slip passages in the form of metering grooves 34 are formed in front face 30 of pressure plate 28. Metering grooves 34 preferably have an arcuate configuration about the axes of shafts 20 and 24.

As gears 22 and 26 rotate, pockets formed between adjacent teeth of each gear first are in fluid communication with inlet 16. Continued rotation of the gears brings their teeth into sealing engagement with housing 12 at inlet seal points 36. At this point the pockets between adjacent gear teeth no longer communicate with inlet 16, and fluid is trapped therein. Similarly, sealing contact between the gear teeth and housing 12 is broken as the teeth rotate beyond outlet seal points 38. At this point the pockets formed between adjacent gear teeth come into fluid communication with outlet 18. Thus there are in effect three zones for each gear; a first zone subjected to inlet pressure, a second, intermediate zone between inlet seal point 36 and outlet seal point 38 in which there is a pressure rise from inlet pressure to discharge pressure, and a third zone subjected to discharge pressure.

As noted above, gear pumps normally are designed to be usable over a wide range of operating conditions. A typical prior art pump might be designed for pressure distribution around the gears corresponding to curve A of FIG. 6 when subjected to an atmospheric inlet pressure. Volumetric efficiency probably would be acceptable even if the inlet were to sense a vacuum of five inches of mercury. Such a pump typically would be provided with a pressure plate 28 having a smooth front face 30 without metering grooves 34.

There are occasions when a user may wish to operate under conditions wherein a vacuum of up to fifteen inches of mercury or more is sensed at the pump inlet. Under such operating conditions, the typical gear pump known in the prior art would have a pressure distribution profile as shown in FIG. 4. This corresponds to curve B of FIG. 6. The pressure rise in the intermediate zone between seal points 36 and 38 would be distorted. As a result, the net force biasing pressure plate 28 toward gears 22 and 26 would be unacceptably high.

Metering grooves 34 compensate for an increased vacuum condition at pump inlet 16 by communicating two or more pockets formed by adjacent gear teeth as they move through the intermediate zone between inlet seal point 36 and outlet seal point 38. The width and depth of metering grooves 34 as well as the arcuate length thereof are predetermined to compensate for the anticipated increased vacuum at pump inlet 16. A small volume of fluid in a pocket subjected to relatively high pressure is metered back to a pocket subjected to relatively low pressure. As a result, the pressure distribution profile takes the form shown in FIG. 5. This corresponds to curve C of FIG. 6. The net force biasing pressure plate 28 toward gears 22 and 26 effectively is reduced to an acceptable level, if not to the original design level.

Figure 6:
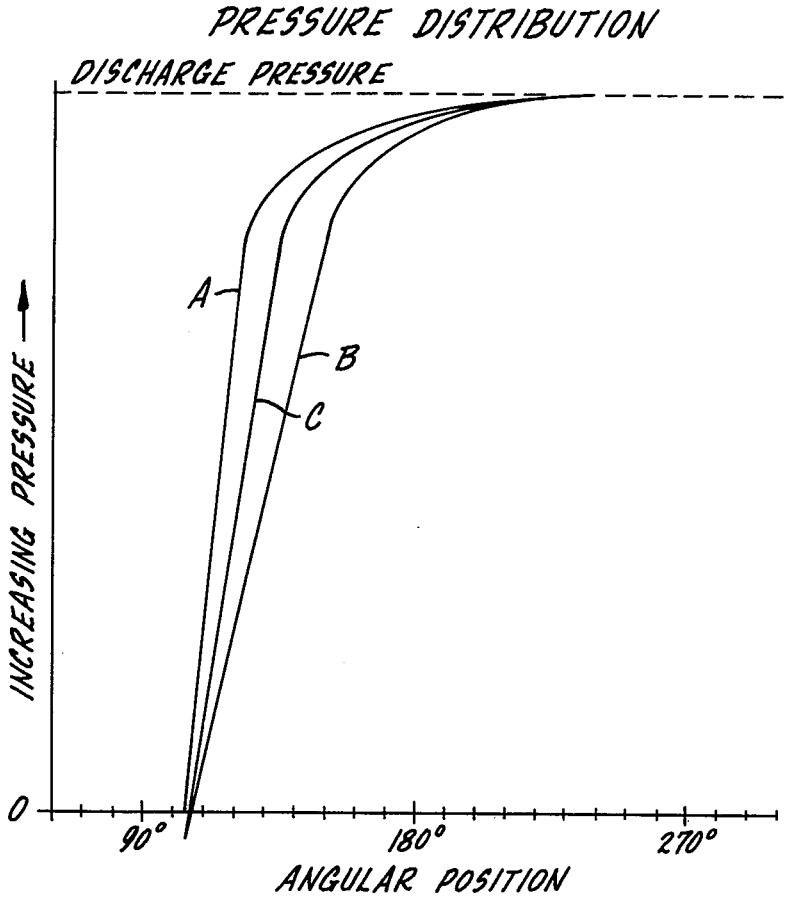
FIG. 6 is a graph illustrating the differences in pressure distribution around a gear pump when operating in a non-vacuum application and in a vacuum application with and without the metering groove.

To recapitulate, curve A of FIG. 6 illustrates the pressure distribution around the gears for a gear pump with no metering grooves and operating in an environment where there is no vacuum at the inlet. Curve B illustrates the distribution for a gear pump with no metering grooves and operating in an environment where there is a high vacuum at the inlet. The pressure distribution is distorted to such an extent that the biasing forces acting on the pressure plate are overbalanced to an unacceptable degree. Curve C illustrates the pressure distribution for a gear pump having metering grooves and operating in an environment where there is a high vacuum at the inlet. The pressure distribution is restored to an acceptable level.

One disadvantage encountered with the introduction of metering grooves 34 is that the slip passages thus created to reduce the volumetric efficiency of the pump. Flow losses through slippage are reduced significantly by orienting metering grooves 34 such that they do not cross beyond seal points 36 and 38. That is, grooves 34 do not communicate directly with inlet 16 or outlet 18.

By increasing the forces acting on front face 30 of pressure plate 28, metering grooves 34 alter the pressure distribution profile so as to compensate for a high vacuum condition at pump inlet 16. As a result, the net of forces tending to bias pressure plate 28 toward gears 22 and 26 is restored to an acceptable operating level at or near the design level, even when pump 10 is operated under vacuum inlet conditions for which the pump was not originally designed.

In addition to altering the pressure distribution profile, metering grooves 34 provide fluid which helps maintain a lubricating film between the gear faces and front face 30 of pressure plate 28. In this regard, it may be desirable to form metering grooves 34 such that they are partially below the root diameter of gears 22 and 26.

In the preferred embodiment of the invention, one or two pressure plates may be provided, and grooves 34 may be formed in either one or both of them. An important advantage of this embodiment is that it may be used with pumps already in the field simply by substituting pressure plates having suitable metering grooves for existing pressure plates.

DESCRIPTION OF ALTERNATIVE EMBODIMENTS

Control of the pressure distribution profile in a gear pump may be accomplished in several ways. FIG. 7 shows a modified form of the invention wherein pressure plate 28 does not define metering grooves 34 in front face 30. Rather, pressure plate 28 defines chamfers 40, each having a suitable flow area and extending sufficiently to communicate the desired pockets.

In this embodiment as well as the preferred embodiment either one or two pressure plates may be provided, with metering grooves in either one or both of them, as desired. This embodiment also may be used as an aftermarket item for pumps already in the field.

As shown in FIG. 8, metering grooves 42 may be formed on the interior of housing 12 facing chamber 14, rather than in pressure plate 28. The flow area and length of metering grooves 42 would be suitably sized to provide the desired fluid metering and to communicate as many pockets as desired.

As shown in FIG. 9, suitable metering passages 44 may be formed within housing 12. Passages 44 also communicate any two or more pockets between seal points 36 and 38, as desired.

To reduce slip losses altogether, fluid from an external source may be directed into the desired pockets through one or more suitable fluid lines 46, as shown in FIG. 10.

Thus it will be seen that the invention herein discloses apparatus by which the operating range of gear pumps may be extended to include use in environments beyond design applications originally intended.

It is to be understood that while a preferred embodiment and alternative embodiments of the invention have been shown and described, this should be considered as illustrative and may be modified by those skilled in the art. It is intended that the claims herein cover all such modifications as may fall within the spirit and scope of the invention.

What is claimed is:

1. In a pressure plate adapted for use in a gear pump including a pair of gears defining pockets between adjacent teeth thereof, said pockets normally being sealed from communication with the pump inlet and outlet as said teeth rotate between inlet and outlet seal points; the improvement comprising slip passage means defined by said pressure plate, said slip passage means communicating selected ones of said sealed pockets.

2. The invention of claim 1, said slip passage means being a pair of chamfers in the edge of the face of said pressure plate contiguous of said gears, said chamfers respectively communicating selected sealed pockets of an associated gear.

3. The invention of claim 1, said slip passage means being metering groove means in the face of said pressure plate contiguous to the side faces of said gears.

4. The invention of claim 3, said metering groove means being a pair of metering grooves respectively communicating selected sealed pockets of an associated gear.

5. The invention of claim 4, said metering grooves respectively being oriented at least partially above the root diameter of an associated gear.

6. The invention of claim 4, said metering grooves respectively being oriented arcuately about the axis of rotation of an associated gear.

7. In a fluid pump, a combination comprising a housing defining a chamber; a fluid inlet and a fluid outlet communicating with said chamber; a pair of gears supported for rotation in said chamber; and at least one pressure plate in said chamber interposed between said housing and the side faces of said gears, each of said gears defining pockets between adjacent teeth thereof, said pockets normally being sealed from communication with said inlet and outlet between inlet and outlet seal points as said teeth rotate into sealing contact with said housing at said inlet seal point and out of sealing contact therewith at said outlet seal point; and means for metering fluid between selected sealed pockets.

8. The invention of claim 7, said means being constructed and arranged to meter fluid into selected sealed pockets from an external source.

9. The invention of claim 7, said means being defined by said housing.

10. The invention of claim 9, said means being a pair of grooves in said housing contiguous to the teeth of said gears, said grooves respectively communicating selected sealed pockets of an associated gear.

11. The invention of claim 9 said means being a pair of passages formed in said housing, said passages respectively communicating selected sealed pockets of an associated gear.

12. The invention of claim 7, said means being defined by said pressure plate.

13. The invention of claim 12, said means being a pair of chamfers in the edge of the face of said pressure plate contiguous to the side faces of said gears, said chamfers respectively communicating selected sealed pockets of an associated gear.

14. The invention of claim 12, said means being a pair of grooves in the face of said pressure plate contiguous to the side faces of said gears, said grooves respectively communicating selected sealed pockets of an associated gear.

15. The invention of claim 14, said grooves respectively being oriented at least partially above the root diameter of an associated gear.

16. The invention of claim 14, said grooves respectively being oriented arcuately about the axis of rotation of an associated gear.

* * * * *